United States Patent [19]

Dean

[11] Patent Number: 4,845,992

[45] Date of Patent: Jul. 11, 1989

[54] METHOD AND APPARATUS FOR BENDING ROTOR VANES

[76] Inventor: Michael J. Dean, 10465 Reese Rd., Clarkston, Mich. 48016

[21] Appl. No.: 136,825

[22] Filed: Dec. 22, 1987

[51] Int. Cl.[4] ..... B21D 53/78

[52] U.S. Cl. ..... 72/7; 72/22; 72/702; 29/156.8 B

[58] Field of Search ..... 72/7, 9, 22, 30, 702, 72/465; 29/156.8 B; 901/41, 49

[56] References Cited

U.S. PATENT DOCUMENTS

| | | | |
|---|---|---|---|
| 3,469,434 | 9/1969 | Davis | 72/454 |
| 3,837,198 | 9/1974 | Higgins | 29/156.8 B |
| 4,024,646 | 5/1977 | Griggs | 72/7 |
| 4,178,632 | 12/1979 | Anthony | 364/513 |
| 4,267,424 | 5/1981 | Shimatake et al. | 219/86.41 |
| 4,356,378 | 10/1982 | Cloos et al. | 219/124.1 |
| 4,380,696 | 4/1983 | Masaki | 219/124.34 |
| 4,425,776 | 1/1984 | Judge, Jr. | 72/9 |
| 4,553,077 | 11/1985 | Brantmark et al. | 318/568 |
| 4,578,562 | 3/1986 | Lindström et al. | 219/125.1 |
| 4,631,689 | 12/1986 | Arimura et al. | 364/513 |
| 4,635,206 | 1/1987 | Bhatia et al. | 364/474 |
| 4,658,385 | 4/1987 | Tsuji | 367/105 |
| 4,661,038 | 4/1987 | Kohler et al. | 901/49 |
| 4,674,057 | 6/1987 | Caughman et al. | 364/513 |
| 4,685,067 | 8/1987 | French et al. | 364/513 |
| 4,691,419 | 9/1987 | Keeler et al. | 29/39 |

FOREIGN PATENT DOCUMENTS 3322777 1/1985 Fed. Rep. of Germany ..... 72/702

*Primary Examiner*—Lowell A. Larson
*Attorney, Agent, or Firm*—Basile and Hanlon

[57] ABSTRACT

The vane adjusting machine for increasing or decreasing the flow through a turbine nozzle includes a bending tool for attachment to a wrist of a robot arm whose operation and function is controlled by computer hardware and software. The bending tool preferably includes a floating head assembly and an interchangeable jaw sub-assembly. In operation, a turbine nozzle is subjected to an airflow test. Subsequently, the turbine nozzle is mounted on a rotatable work surface and a first vane is initialized to a bending station location. The bending tool controlled by the computer then locates and bends the first vane to a desired orientation based on the airflow test results. On completion of the bending of the first vane, the bending tool is removed from proximity with the first vane, and the computer controls the rotation of the worktable to position a second vane at the bending station location. Each vane on the turbine nozzle is subsequently bent to the desired orientation and, if desired, the turbine nozzle is subjected to a second airflow test to verify that the desired airflow characteristics have been achieved.

19 Claims, 10 Drawing Sheets

METHOD AND APPARATUS FOR BENDING ROTOR VANES

FIELD OF THE INVENTION

The invention relates to a method and apparatus for bending metal parts, and in particular, for bending the vanes or blades of turbine rotors.

BACKGROUND OF THE INVENTION

The manufacturing processes currently existing for making turbine rotors produce finished products with relatively large tolerances. Quality control testing of these rotors, such as an air flow test conducted on a Fleming machine results in numerous parts being rejected for failure to fall within the desired or specified optimum air flow characteristics for the particular size and design of the rotor being manufactured. Currently, many of these nonconforming parts are scrapped or, in the alternative, are subjected to crude manual methods of adjustment in an attempt to correct the air flow characteristics of the noncomplying turbine rotors.

It has long been desired to provide an automated system for correcting the orientation of vanes on rotors to consistently produce optimum air flow characterstics; however, numerous problems have hindered the development of a cost effective, versatile, automated vane bending apparatus. In particular, it would be desirable to provide a method and apparatus for bending rotor vanes, which measures the orientation of each vane on a rotor for comparison to an optimum position; that calculates the amount of force and direction of force for bending, if necessary, to reach the desired optimum position, with respect to the material of the vane and the size and shape of the vane and the rotor; that automatically allows for spring-back of the material after the bending force has been released; that indicates when the rotor has a missing vane or the like; and that can be adapted to handle numerous different sizes and shapes of rotor vanes. The present invention provides for these desirable characteristics, features and advantages.

SUMMARY OF THE INVENTION

The present invention discloses an apparatus and method for bending rotor vanes. The apparatus is designed for use in conjunction with standard computer hardware, such as our IBM Model XT, and known computer-controlled robotic arms, such as Asea Model No. IRB-60, the apparatus includes a specially designed bending tool for connection to the end of the robotic arm, and a computer program to control the movement and function of the bending tool. The bending tool includes a floating head design having a frame member securely connected to the robotic arm. A floating head is attached to the frame member using ball and socket elements with pre-loaded springs to bias the floating head to a neutral position. A movable member having a threaded portion at one end and a bending surface at another end passes through the floating head and frame assembly. Means, mateable with the threaded portion of the movable member, are provided for moving the member along the axis to clamp a vane between the bending surface of the member and a corresponding bending surface connected to the floating head. The floating head allows sufficient movement of the bending tool to assure that the vane is orientated squarely between the bending surface of the movable member and the bending surface of the floating head. After insertion of the bending tool on the vane, the movable member is moved until it touches the vane. A sensor indicates that the vane has been located and the existing location of the vane is recorded. If the vane requires bending, the movable member is drawn toward the bending surface of the floating head by appropriate action of the moving means. After completing the bending operation, the bending tool opens, which allows the material to spring back, and the location of the vane after bending is rechecked by the bending tool. The bending tool can have various types of bending surfaces, depending upon the particular shape and design of the vane to be bent.

In operation, the rotor is first tested prior to bending on a Fleming air-flow machine. The air flow test determines whether the rotor is within acceptable limits of air flow for that particular part. If the air flow needs to be adjusted for that part, the rotor is manually clamped on a rotatable table. The computer program is initialized to a first vane on the rotor while being clamped to the rotatable table. The bending tool is robotically inserted onto the vane. The computer program first measures the current position of the vane to determine whether the vane needs to be bent. If the vane is not in the proper position, the computer program initiates the bending of the vane according to a self-taught table which predicts the degree of bending necessary to bring the vane into the desired orientation. After bending the vane, the computer program rechecks the location of the vane to determine if the desired orientation has been achieved. If the desired orientation has been achieved, the rotary table then indexes to move a second vane to the bending station location. The entire process takes approximately ten seconds per vane on the rotor.

After an appropriate start-up and self-teaching time has elapsed, it has been found that the apparatus can achieve the desired oritentation of the vanes for the proper or optimum air flow without repeating the bending process. The bending apparatus even accounts for the material spring-back in the vane after the bending operation is performed. In addition, the computer program will reject any part having missing vanes on the rotor. If desired, the part can be retested on the Fleming air-flow device to verify proper air flow characteristics of the rotor.

BRIEF DESCRIPTION OF THE DRAWINGS

These and other objects, features and advantages of the invention will become more apparent by reference to the following detailed specification to be read in context with the drawings in which.

DESCRIPTION OF THE PREFERRED EMBODIMENTS

Figure 12:
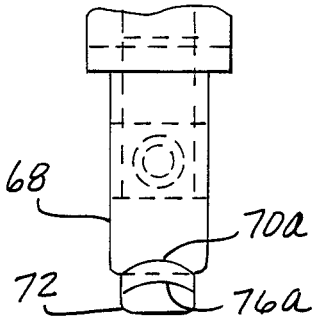
FIG. 12 is a partial front view showing a configuration of the sub-assembly of the bending tool for increasing flow.
Figure 13:
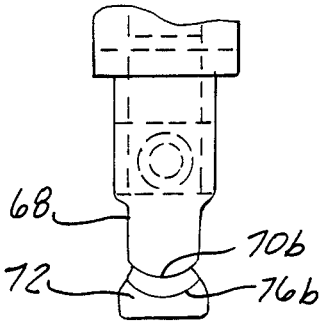
FIG. 13 is a partial front view of the sub-assembly of the bending tool for reducing flow.
Figure 14:
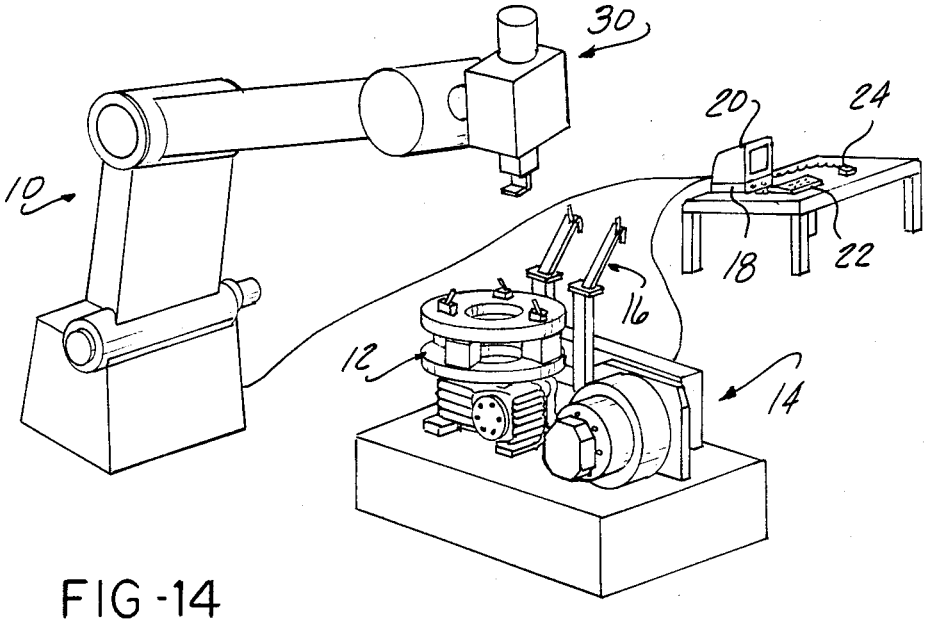
FIG. 14 is a perspective view showing a robotic arm, supporting the bending tool adjacent a rotatable work surface with pivotable arms for initializing a first vane at a bending station location and a computer for controlling the robot arm, bending tool and rotatable table.

The present invention is used is conjunction with a robot arm 10; a rotatable work surface 12, including means 14 for rotating the rotatable work surface 12; means, such as pivotable locator arms 16, for locating a first vane 28 of a turbine nozzle or rotor 26; a computer 18 comprising a single computer or multiple interconnected or networked computers and having a display 20, an attached keyboard 22, and a wand 24 for entering bar codes as shown in FIG. 14. The bending tool or vane adjustment machine, designated generally 30, is shown in various views and cross sections in FIGS. 1–14. Exemplary configurations of an interchangeable jaw sub-assembly 32 of the bending tool 30 are shown in FIGS. 8–13, which will be described in greater detail below.

Figures 1, 4, 5, 6, 7, 8, 9:
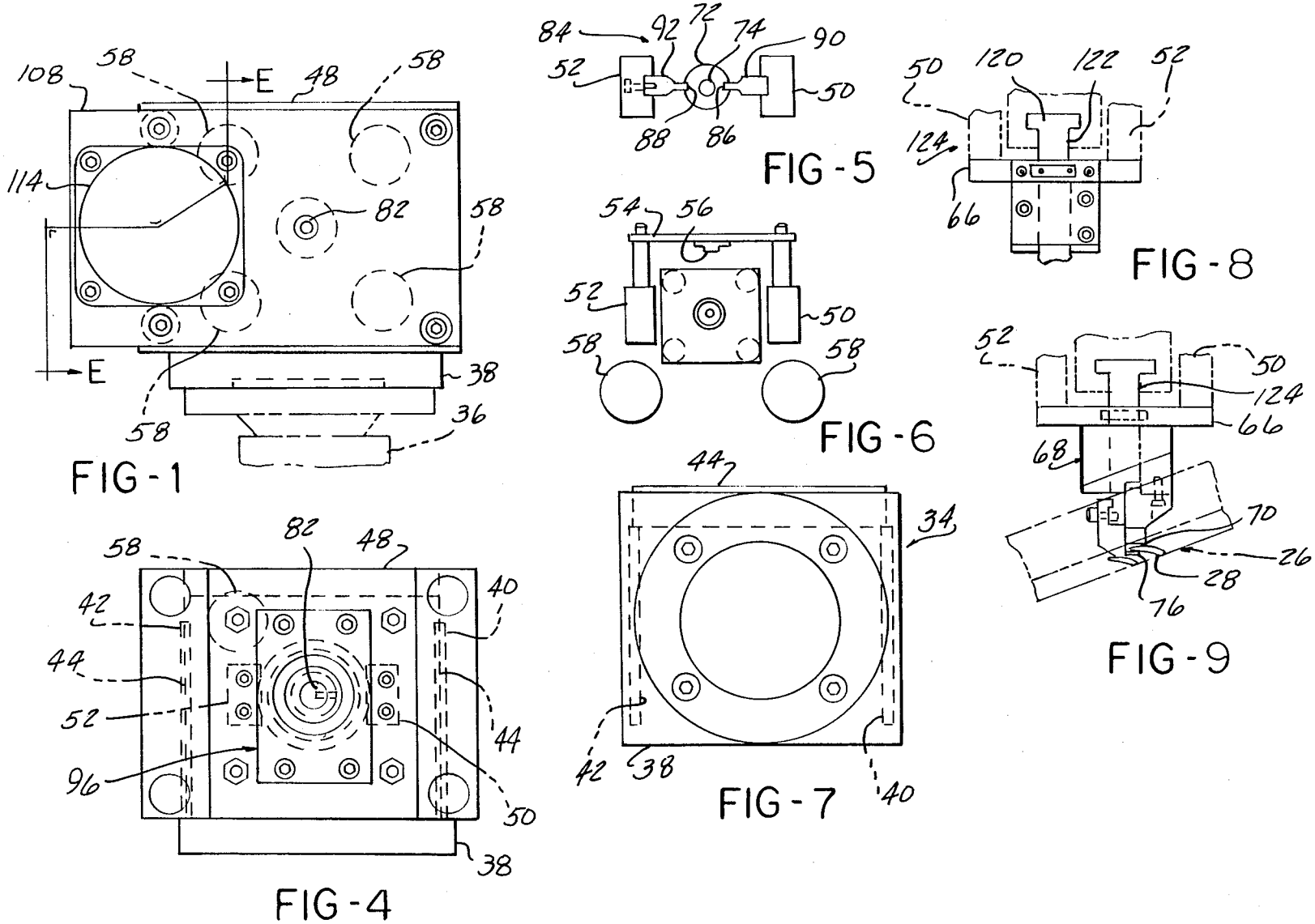
FIG. 1 is a plan view of a bending tool for attachment to a robot wrist according to the present invention.
FIG. 4 is a sectional view of the bending tool taken as shown along section A—A in FIG. 2.
FIG. 5 is a sectional view of the bending tool taken along section B—B shown in FIG. 2.
FIG. 6 is a sectional view taken along section C—C shown in FIG. 2.
FIG. 7 is a side view of a mounting plate for attachment of the bending tool to the robotic wrist taken as shown in FIG. 3.
FIG. 8 is a detail showing an attachment of an interchangeable sub-assembly of the bending tool.
FIG. 9 is a partial side view showing the engagement of the sub-assembly with a first stage rotor vane for a first turbine nozzle.
Figure 2:
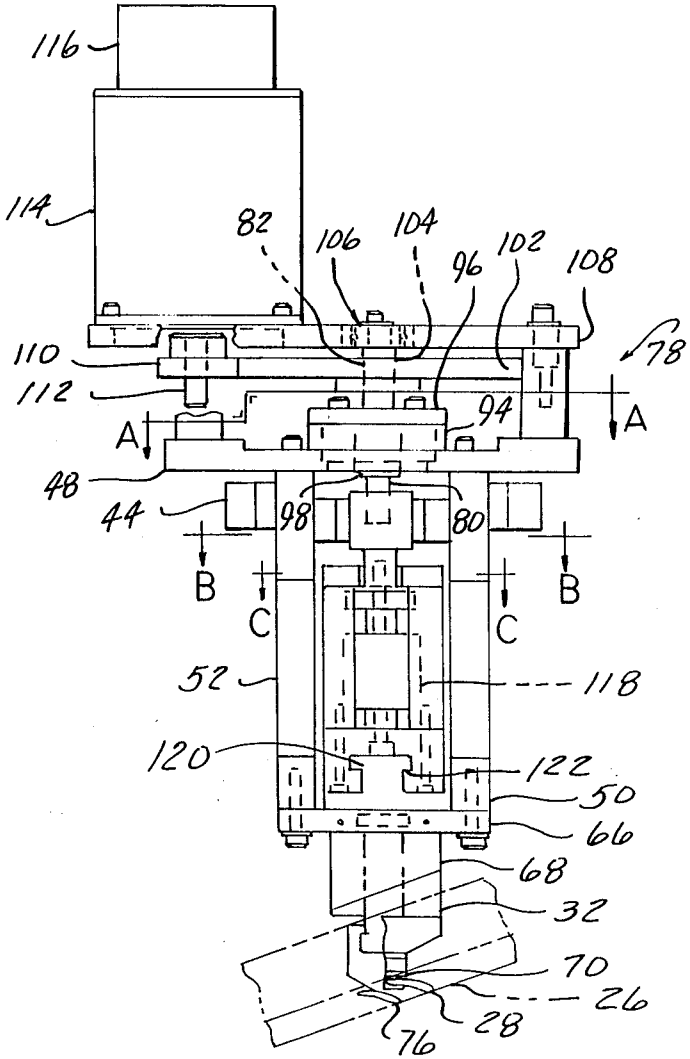
FIG. 2 is a side view of the bending tool shown in FIG. 1.
Figure 3:
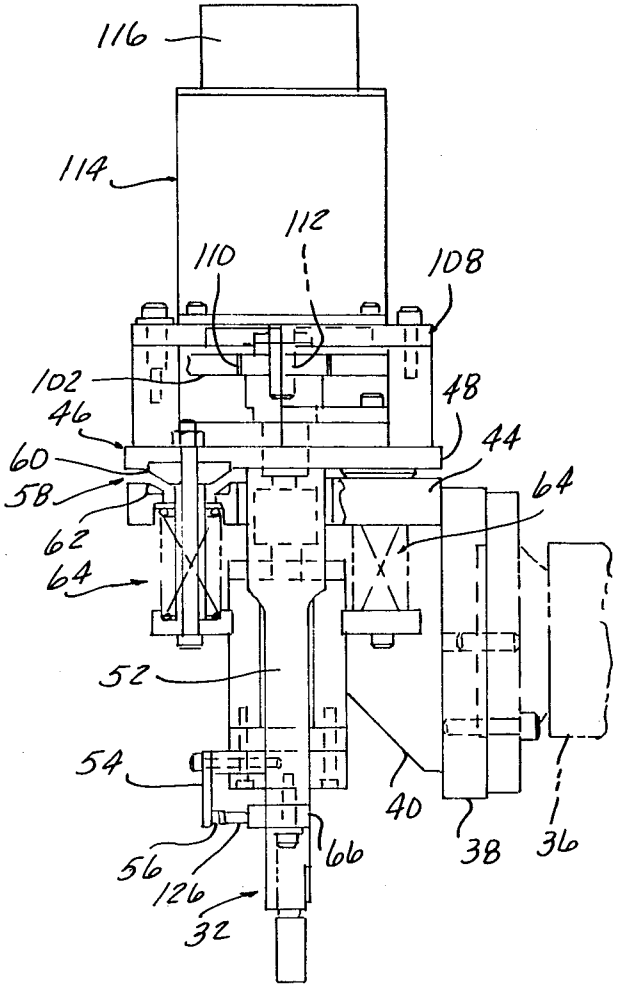
FIG. 3 is a partial cross sectional view of the bending tool shown in FIG. 1 taken along section E—E.
Figure 10:
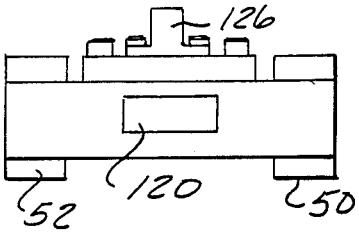
FIG. 10 is a partial plan view showing the orientation of the turbine nozzle with the sub-assembly of the bending tool.
Figure 11:
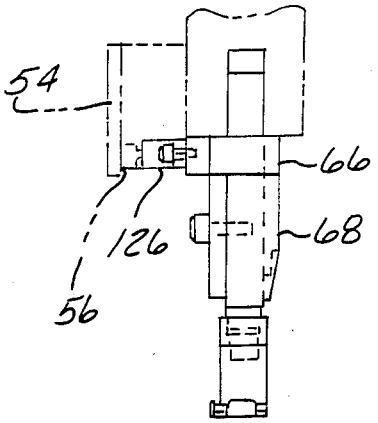
FIG. 11 is a partial rear view showing the sub-assembly of the bending tool.

The bending tool or vane adjustment machine 30 is connected to the robot arm 10 by a frame 34 adapted to be secured to a robot wrist 36 shown in phantom in FIGS. 1 and 3. The frame 34 includes an adaptor plate 38 which is securely affixed to the robot wrist 36 by means of screws or the like. The frame 34 also includes first and second frame supports, 40 and 42 respectively, and an upper frame plate 44, which can be seen best in FIGS. 3 and 7. The robot arm 10 and robot wrist 36 allow for three dimensional movement of the frame 34 to insert and remove the bending tool 30 into proximity with the vane 28 of the turbine nozzle 26.

A floating head assembly 46 is connected to and supported by the frame 34 with a plurality of pivotable joints 58 allowing movement of the floating head assembly 46 relative to the rotor vane 28, such that the floating head assembly 46 can pivot slightly in three dimensions to achieve squared alignment of the floating head assembly 46 with respect to the rotor vane 28. The pivotable joints 58 include a ball joint 60 connected to the first plate 48 and in sliding contact with a socket joint 62 connected to the upper frame plate 44. Spring means 64 are provided for biasing the floating head assembly 46 toward a neutral position. The floating head assembly 46 also includes first and second legs, 50 and 52 respectively, connected to the first plate 48. Toward the outer ends of the first and second legs, 50 and 52 respectively, and spaced outwardly from the legs, is a connector plate 54 spanning between the first leg 50 and the second leg 52. Attached to the connector plate 54 is a connector plug 56. The connector plug 56 engages with a corresponding, mating connector plug 126 disposed on each of the interchangeable jaw sub-assemblies 32 for signalling to the computer 18 the configuration of the installed jaw sub-assembly 32. A second plate 66 is releasably connected between the first leg 50 and the second leg 52 at their outermost ends. A housing member 68 is connected to the second plate 66. A first vane engaging surface or anvil 70 is disposed on the housing member supported by the floating head assembly 46. An elongated movable member 72 has a threaded portion 74 at one end and a second vane-engaging surface or nosepiece 76 at another end. The movable member 72 is supported by the floating head assembly 46 and passes through the housing member 68 and the second plate 66 allowing longitudinal movement of the movable member 72 along an axis to clamp the rotor vane 28 between the first vane engaging surface 70 on the floating head assembly 46 and the second vane engaging surface 76 on the movable member 72. The clamping of the first and second vane engaging surfaces form a foil on the vane and/or allow bending, twisting, or altering of the form, shape or angle of the vane. Means 78, mateable with the threaded portion 74 of the movable member 72, are provided for moving the movable member 72 along the axis. The moving means 78 can include a threaded portion 80 of a rod or spindle 82 engaging within the threaded portion 74 of the movable member 72. The movable member 72 is provided with anti-rotation means 84 for preventing rotation of the movable member 72 while allowing movement along the longitudinal axis. The anti-rotation means 84 can include keyways 86 and 87 formed on the outer surface of the elongated member 72 and keys 90 and 92 extending inwardly from the first and second legs 50 and 52, respectively, engaging within the keyways 86 and 88 as shown in FIG. 5. The spindle 82 passes through the first plate 48 and is supported by a first bearing 94 retained within a bearing housing 96. A snap ring 98 is connected below the first plate 48. Above the bearing housing 96, a first gear or drive gear 102 is keyed to the spindle 82 and securely fixed on the spindle 82 by a set screw. The first gear 102, for example, can have 90 teeth with a pitch diameter of 4.5 and a diametral pitch of 20. The spindle 82 is supported at a far end by a second bearing 106 passing through and supported by a third plate 108 spaced from and supported by the first plate 48. A second gear or drive gear 110 engages with the first gear 102. The second gear 110, for example, can comprise a gear having 24 teeth with a pitch diameter of 1.2 and a diametral pitch of 20. The second gear 110 is connected to a shaft 112 of a motor 114, such as a Compumotor "M" Series Model 83-93. The motor 114 is supported by the third plate 108 and is controlled by a controller 116, such as a Compumotor encoder. The rotation of the motor 14 is controlled through the controller 116 by the computer 18. Rotation of the motor causes the drive gear 110 to rotate driving the driven gear 102, which in turn rotates the threaded portion of the spindle 82 to cause the movable member 72, by engagement with the threaded portion 74 of the movable member 72, to move axially in a given direction at a given rate depending upon the gear ratio selected for the first and second gears 102 and 110, and the number of threads per inch formed on the mating threaded portions 74 and 80, respectively. The examples given with reference to the gear ratios are given as exemplary, and are not to be construed as limiting the scope of the invention disclosed herein, as various configurations of the gear ratios and mating threads may be chosen to provide the desired longitudinal movement since such adaptation of the disclosed invention is to be considered within the knowledge of those skilled in the art.

The movable member 72 includes means 118, responsive to engagement of the second vane-engaging surface or nosepiece 76 with the rotor vane 28, for sensing the actual position of the rotor vane 28. The sensing means 118 can comprise, for example, a Sensotec Load Cell 34 with a load range of 50 inch-pounds. The Sensotec load cell could also be used as a means for monitoring or controlling the amount of bending force applied to the vane 28 when bending the vane, although the load cell is not used in this manner in the present configuration of the invention. The sensing means 118 operates by registering an increased load when the second vane engaging surface 76 touches the vane 28, and thereafter signals to the computer 18 that the actual position of the vane 28 has been located. The computer 18 compares the actual location of the vane 28 to the optimum or desired position, and calculates the distance required to bend the vane from the actual position to the optimum position. The motor 114 is then driven by the controller 116 according to an appropriate signal from the computer 18 corresponding to the required distance of bending. The motor 114 is then reversed to release the bending force, allowing the vane 28 to spring back slightly due to the material composition of the vane. The bending tool can then be removed from proximity with the vane, and the rotor can be rotated on the rotatable table 12 by the means for rotating 14 to position a second vane 28 at the bending station location.

The elongated movable member 72 is particularly adapted for interchanging the vane engaging surfaces 70 and 76. This is provided by making an interchangeable jaw sub-assembly 32 for connection to the floating head assembly 46. One embodiment of the sub-assembly 32 is shown in FIGS. 8–13. The sub-assembly 32 includes the second plate 66, the housing member 68, and the first vane engaging surface or anvil 70. The lower end of the movable member is also included in the sub-assembly 32 including the second vane engaging surface or nosepiece 76. The lower end portion of the movable member 72 opposite from the nosepiece 76 includes a T-shaped slide 120 slidably engageable within a T-shaped aperture 122 forming means 124 for interchanging the vane engaging surfaces. The interchanging is accomplished by releasing the second plate 66 from the first and second legs, 50 and 52, respectively, by loosening the attaching screws or other attachment means. After the screws or other attachment means have been removed, the T-shaped slide 120 can be slidingly disengaged from within the T-shaped aperture 122. Disengagement of the T-shaped slide 120 also disengages a connector plug 126 from engagement with the corresponding connector plug 56 on the connector plate 54. The connector plug 126 is connected to the second plate 66. A different jaw sub-assembly can then be mounted by slidably engaging an identical T-shaped slide 120 within the T-shaped aperture 122. Each of the jaw sub-assemblies 32 has a connector plug 126 for engagement with the corresponding connector plug 56 on the connector plate 54, which signals to the computer 18 the exact configuration of the jaw sub-assembly 32 which is mounted on the bending tool 30. After engagement of the T-shaped slide and corresponding aperture, 120 and 122 respectively, the second plate 66 is secured in place with the screws or other attachment means which were previously removed. It is desirable to interchange the jaw sub-assembly in order to change the specific configuration of the anvil 70 and the nosepiece 76. As can be seen in FIGS. 12 and 13, generally speaking, the flow rate of the turbine nozzle 26 can be increased by using a generally concave first vane engaging surface **70*a* on the anvil with a generally corresponding convex second vane-engaging surface 76*a* on the nosepiece as shown in FIG. 12. FIG. 13 illustrates that the turbine nozzle flow is reduced by using a generally convex first engaging surface 70*b* on the anvil in conjunction with a generally corresponding concave second engaging surface 76*b* on the nosepiece. It should be recognized by those skilled in the art that the precise dimensions and curvatures of the vane engaging surfaces 70 and 76 can be readily adapted and changed to adapt the jaws for engagement and bending of various sizes and shapes of rotor vanes without departing from the scope of the invention disclosed herein. The invention disclosed herein can be adapted for vane adjustments to the first stage vanes of a turbine nozzle, as well as the second and third stage vanes of turbine nozzles. The invention disclosed has been adapted for use with turbine nozzles having a radius to the center line of the vane ranging from 2.72 to 3.238 inches with vane widths in the range from 0.56 to 1.524 inches and angles ranging from 17 degrees to 31 degrees. It is anticipated that the invention disclosed could be adapted to adjust vanes falling outside of the above listed ranges; therefore, these ranges are given as exemplary rather than limiting. The first vane engaging surface 70*a* of the anvil can vary in the range from 0.34 to 3.00 inch radius while the corresponding second vane engaging surface 76*a* is in the range from 0.28 to 2.25 inch radius for increasing the flow of the turbine nozzle. The first engaging surface 70*b* of the anvil can range from 0.28 to 3.00 inch radius while the corresponding second vane engaging surface 76*b*** of the nosepiece can range from 0.34 to 5.00 inch radius for reducing the flow through the turbine nozzle. The exact configuration of the vane engaging surfaces for increasing or reducing the flow through the turbine nozzle are determined by trial and error with the specific configuration of the rotor vane to be bent.

Referring now to FIGS. 15A–15G, there is illustrated a flowchart depicting the sequence of the control program executed by the computer 18 in controlling the operation of the apparatus of the present invention in inspecting and adjusting, if necessary, the vanes of a turbine nozzle. The control program interacts with the operator of the apparatus insofar as displaying various prompt commands via a display screen 20 directing the operator to take certain actions and/or enter certain information into the computer 18 via a keyboard 22 or a wand 24, as shown in FIG. 14.

As is conventional, the control program is stored in a memory in the computer 18 and provides storage for the control program, as well as storage for data as described hereafter. The central processing unit of the computer 18 executes the control program as described below.

Figure 15A:
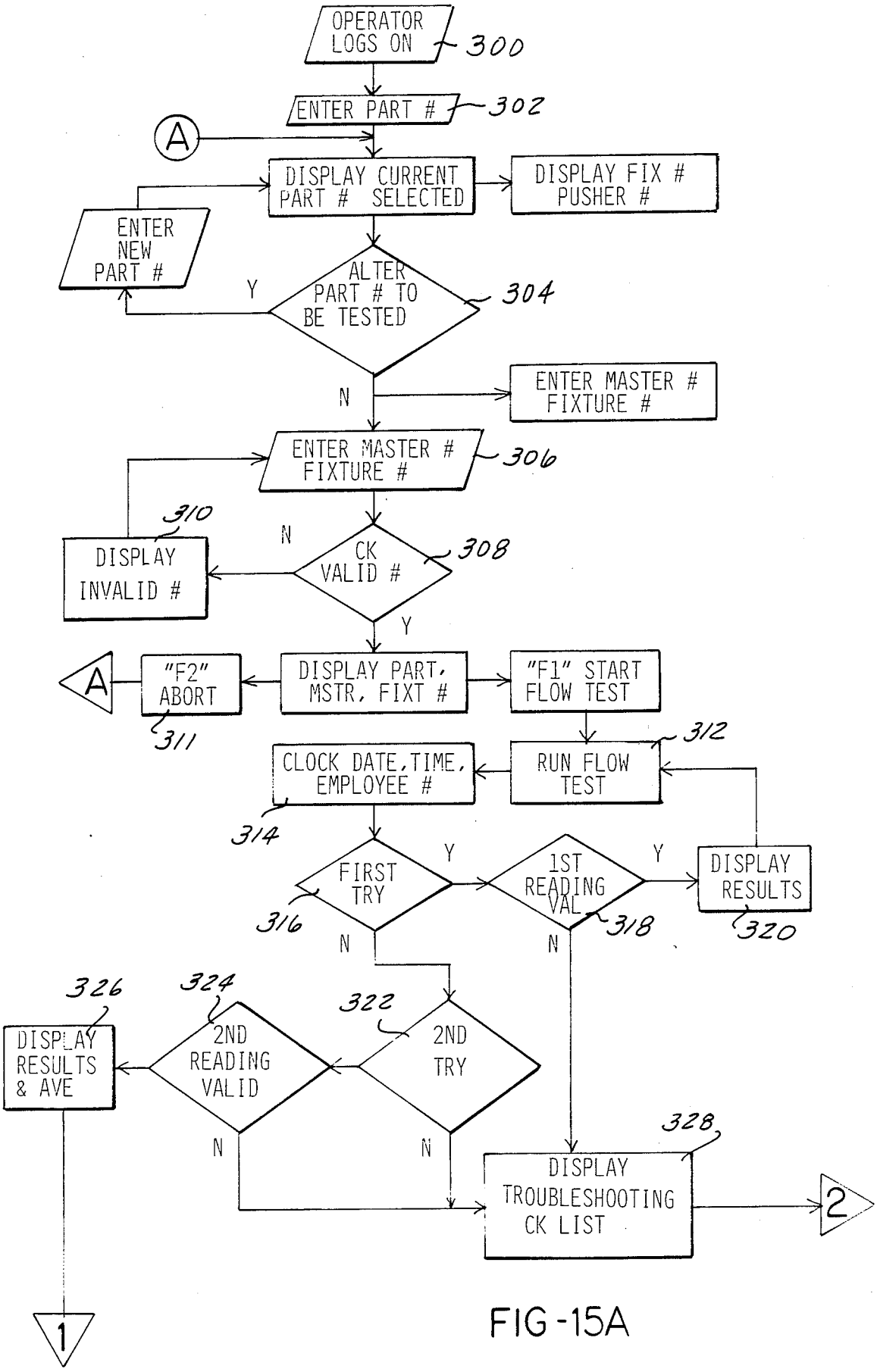
FIGS. 15A–15G are schematic flow diagrams showing the steps used in controlling the bending operation according to the present invention.
Figure 15B:
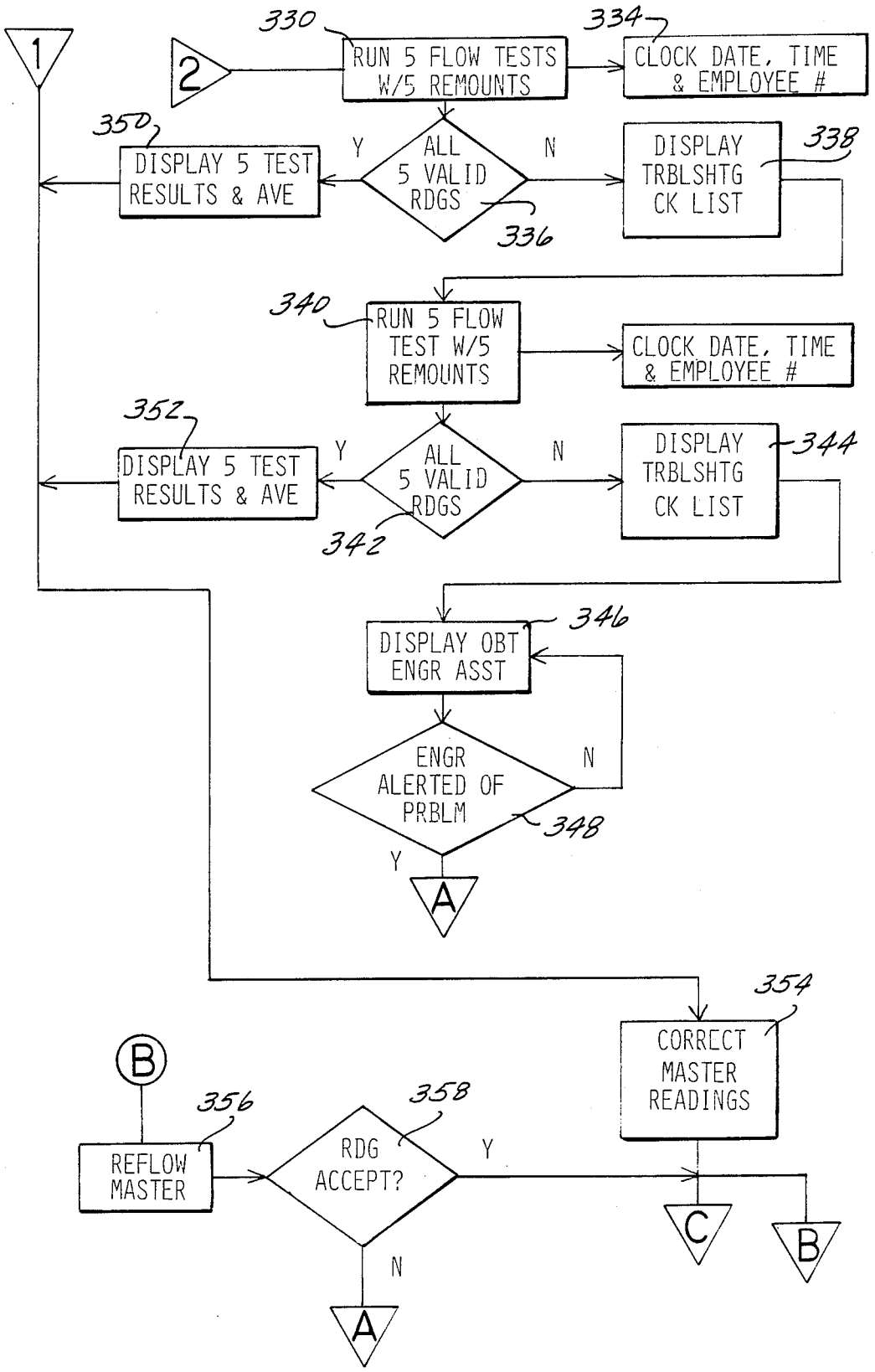

As shown in FIGS. 15A and 15B, the operation starts when the operator logs on in step 300 and enters the part number of a part to be tested in step 302. The control program then causes the current part number selected and the fixture number and pusher number to be displayed on the display 20.

The control program then displays a command questioning whether an alternate part number is to be tested. If yes, the operator enters the new part number into the computer 18 via the keyboard 22 or wand 24. If an alternate part number is not to be tested, the computer then prompts the operator to enter the master number and fixture number which is done by the operator in step 306. The control program then checks to see if the master number and fixture number are valid in step 308 and displays an "INVALID NUMBER" message in 310 on the display 20. If the numbers are correct, the control program causes the part number, master number and fixture number to be displayed.

At this point, the operator in step 311, by pressing function key "F2," may abort a flow test and return to the beginning of the control program to enter a new part number. If the operator desires to initiate the flow test, he presses function key "F1" which initiates the flow test in step 312. At the same time, the control program clocks in the date, time and employee number running the flow test in step 314.

A decision is made in step 316 as to whether this is the first try or attempt for a flow test on a particular part. If yes, a decision is made as to whether the results of the test are valid in step 318. If valid, the results are displayed at step 320.

If this is not the first flow test on a particular part, a decision is made as to whether it is a second try or test in step 322. If yes, the results of the second test are analyzed at step 324 to determine if they are valid. If the results are valid, the results are then displayed in step 326, along with an average of the first and second results on the two flow tests made on a particular part.

In the event that the first reading was not valid, or it is not the second flow test on a particular part, or the second reading is not valid, the control program displays a troubleshooting checklist at step 328 which, as shown in FIG. 15B, initiates five flow tests, each including a remounting of the part as shown in step 330. As before, when each flow test is run, the control program clocks in the date, time and employee number of the employee running the test in step 334.

The results from the five flow tests are checked and, if not valid in decision step 336, the control program displays a troubleshooting checklist in step 338 and initiates a rerun of five additional flow tests in step 340 with five individual remounts of the part. The results of the second set of five flow tests are again are again checked in step 342 for validity and, again, if not valid, the troubleshooting checklist is displayed in step 344, along with a prompt command for engineering assistance. A decision is made as to whether or not the engineering department has been alerted of the problem in step 348. If yes, the control program branches back for a new part number selection and entry.

If the results of either the first or second set of five flow tests are valid from decision steps 336 or 342, the control program causes the results of the five tests and the average result to be displayed in prompt screens 350 or 352. The results are used to correct the master readings for a particular part configuration in step 354. Concurrently, the control program displays a prompt screen 356 advising the operator to reflow or retest the master part and, if the reading is acceptable in step 358, the program branches to enter a new part number or to the flow test sequence for a part if the part is not a master part. In this manner, flow test readings are established for a particular part configuration which is used as a master or gage against which flow tests for other production parts are compared.

Figure 15C:
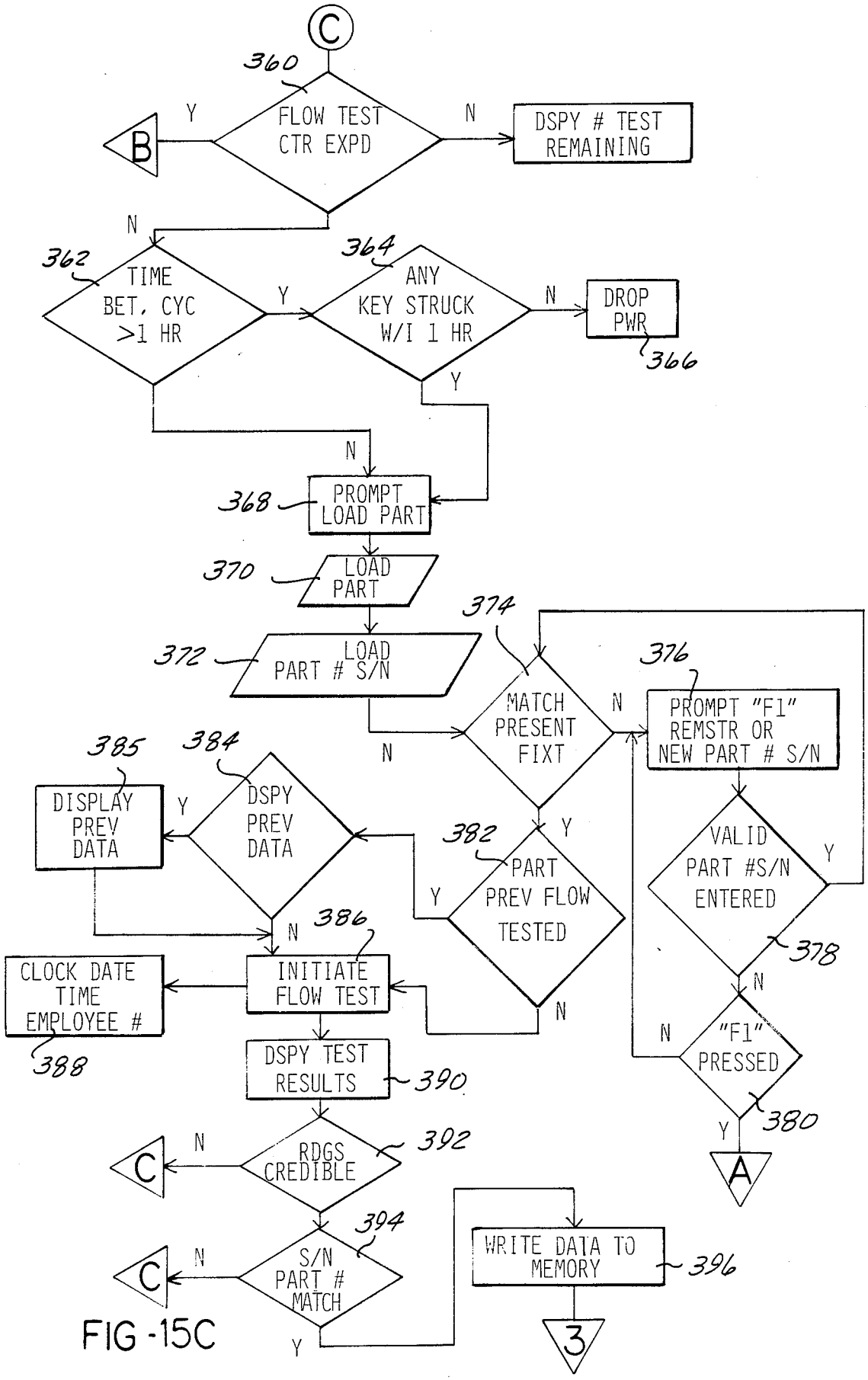

As shown in FIG. 15C, the control sequence for initiating a flow test on production parts is depicted. During each of the five flow tests in the flow mastering sequence described above, a counter is checked in step 360 to determine the number of tests run and to display the number of tests remaining in each five set remastering sequence. If the flow test counter has expired, control is shifted to the remastering sequence as described above. If the flow test counter has not expired, a decision is made in step 362 as to whether the time between flow test cycles has exceeded one hour. If it has been more than one hour between flow test cycles, a decision is made in step 364 as to whether any key on the keyboard 22 has been struck during the preceding hour. If not, the control program drops power to the apparatus in step 366.

If either the time between flow test cycles is less than one hour, or a key on the keyboard 22 has been struck within the preceding hour, the control program generates a "LOAD PART" command in step 368 on the display screen 20.

The operator in steps 370 and 372, respectively, loads the part into the flow test fixture and the part number and serial number of the part into the computer 18 via the keyboard 22 or wand 24. The control program checks in step 374 to determine if the part and serial numbers match the present fixture number. If the answer is no, the control program displays a prompt message in step 376 asking the operator to depress function key "F1" for remastering of the part or to enter a new part number and serial number. If a valid part number and serial number are entered in step 378, the computer again makes the fixture check decision in step 374. If function key "F1" is pressed in step 380, the control program returns to the prompt screen in step 376 as described above.

When the part and serial numbers match the fixture number, the control program determines, in step 382, whether this part had been previously flow tested. If it has, the control program either displays the previous flow test data in steps 384 and 385, or if no display is requested, immediately goes to the initiate flow test in step 386. Along with initiation of the flow test, the control program clocks in the date, time and employee number in step 388.

The flow tests results are displayed in step 390 and if the readings are not credible in decision step 392, a new flow test is initiated. Also, if the serial number and part number match in decision step 394, the flow test data is stored in the computer memory in step 396.

Figure 15D:
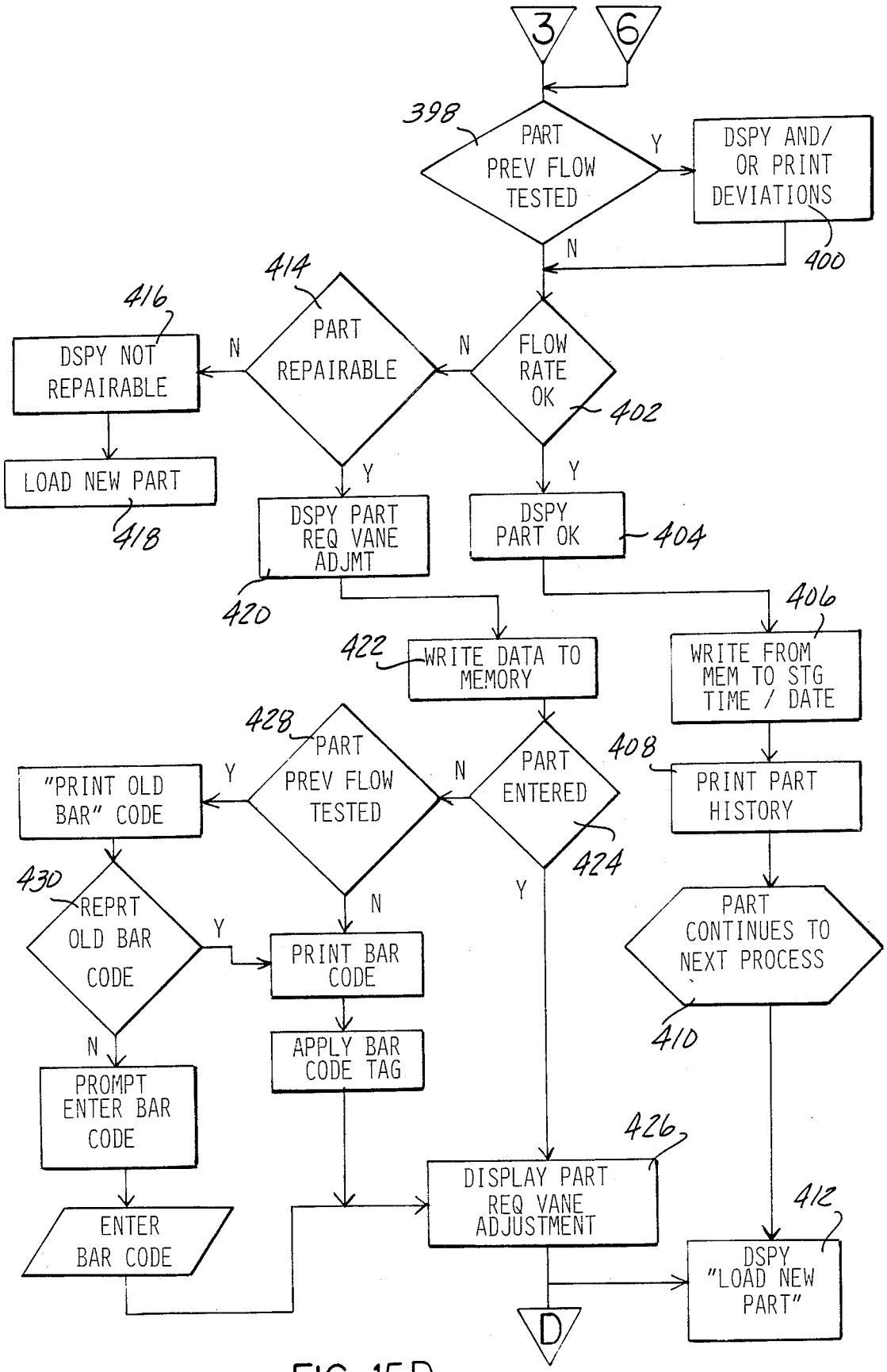

The control program then determines if the part has been previously flow tested in step 398, FIG. 15D, and, if it has, displays and/or prints the flow test deviation in step 400. If the flow rate of the part is okay via decision step 402, the control program displays in step 404 that the part is okay and writes from memory to external storage the time and date in step 406 and prints the part history in step 408. The part then continues to the next process in step 410 and the control program displays "LOAD NEW PART" in step 412 for the next flow test operation.

If the flow rate of a particular part is not optimum in decision step 402, a decision is made as to whether the part is repairable in step 414. If it is not, the control program displays "NOT REPAIRABLE" and a subsequent display in step 418 to load a new part. If the part is repairable, the program generates a display "PART REQUIRING VANE ADJUSTMENT" and writes appropriate control information in step 422 to the memory for the particular part. When the part number is entered in step 424, the control program generates a display "PART REQUIRING VANE ADJUSTMENT" in step 426 and transfers control to the vane adjustment program depicted in FIGS. 15E and 15F.

If the part number has not been entered, a decision is made in step 428 as to whether the part has been previously tested. The steps indicated in general by reference number 430 in FIG. 40D involve printing a bar code on a part which is either the old bar code which came with the part from the manufacturer or a new bar code.

Figure 15E:
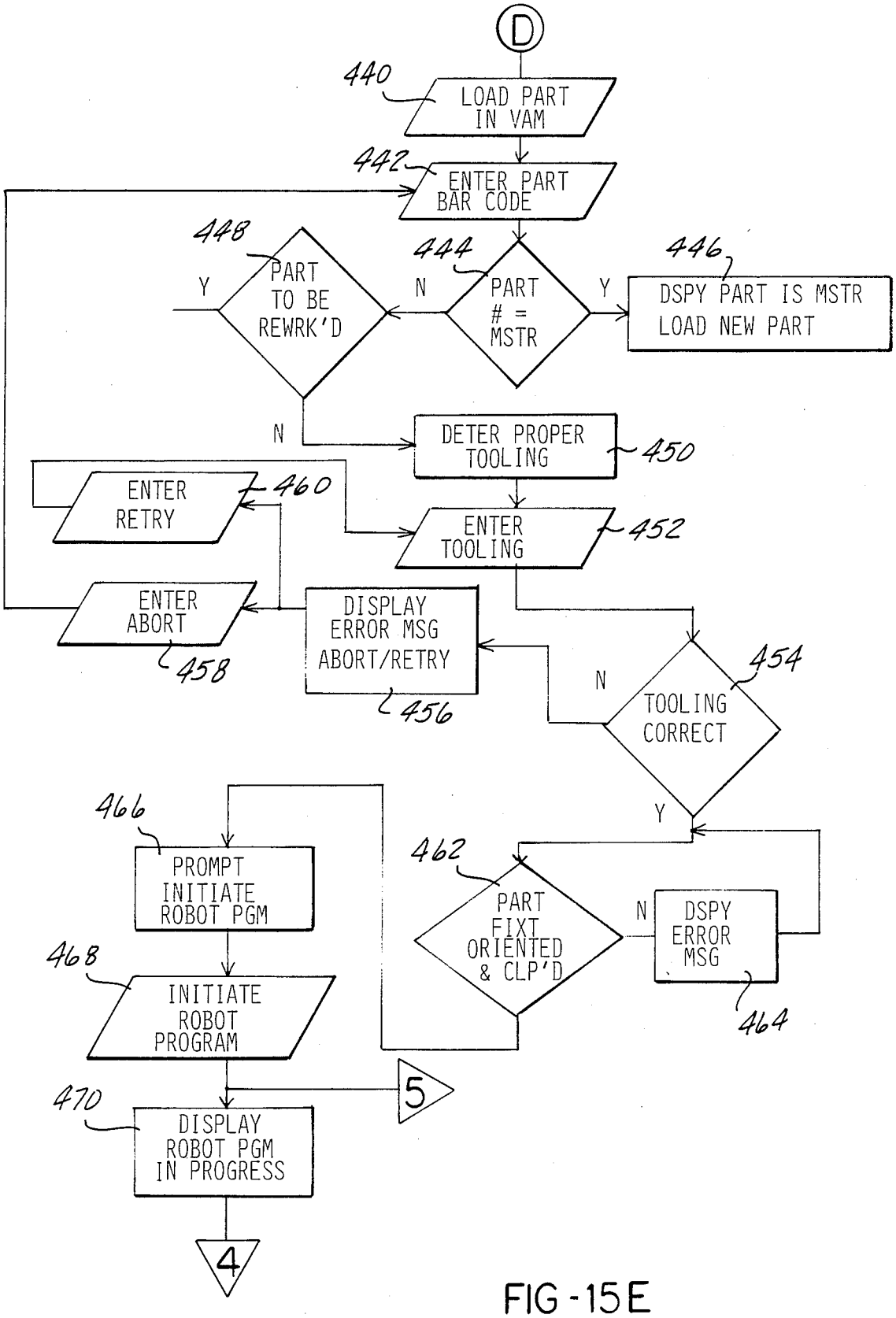
Figure 15F:
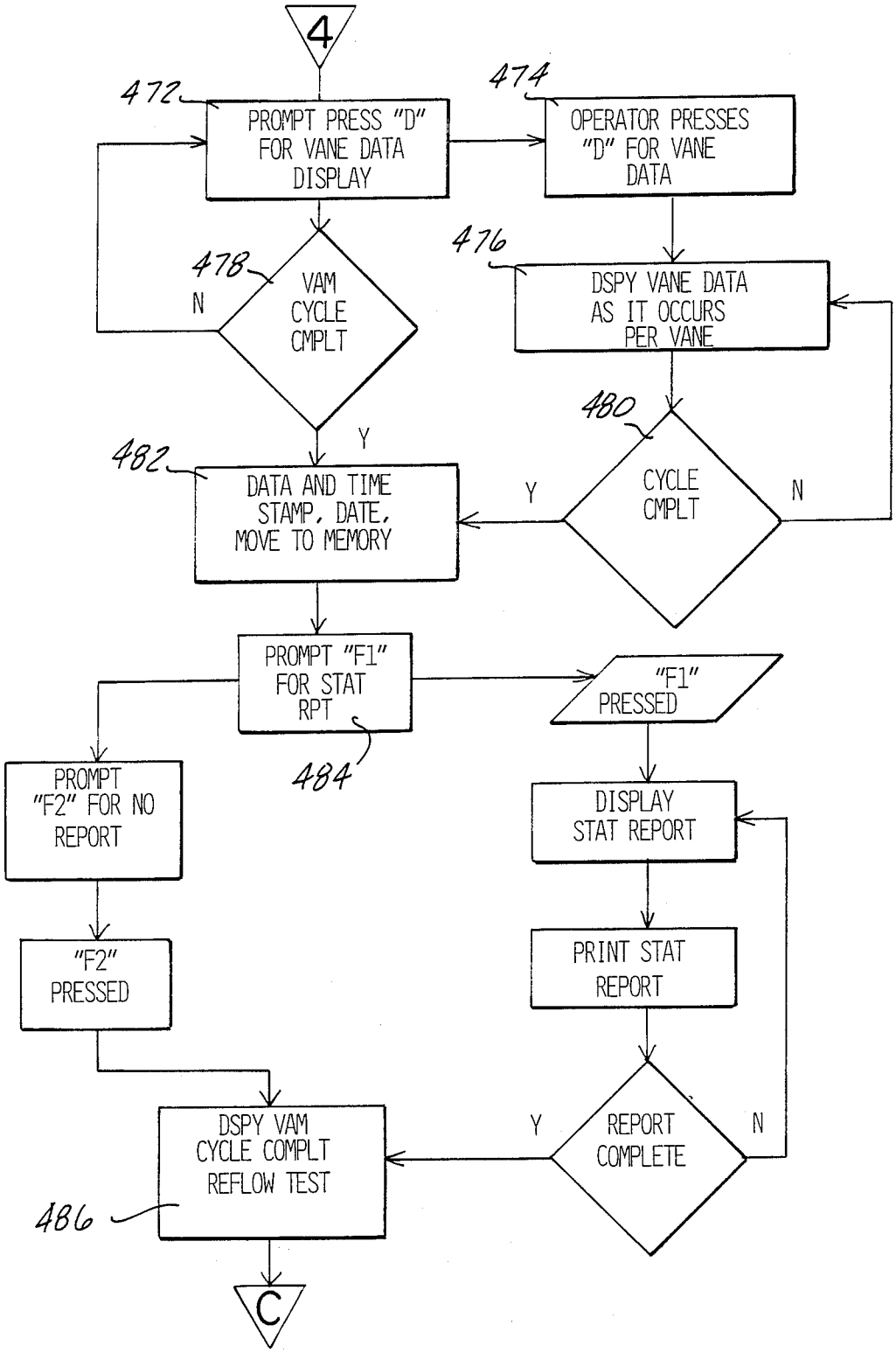
Figure 15G:
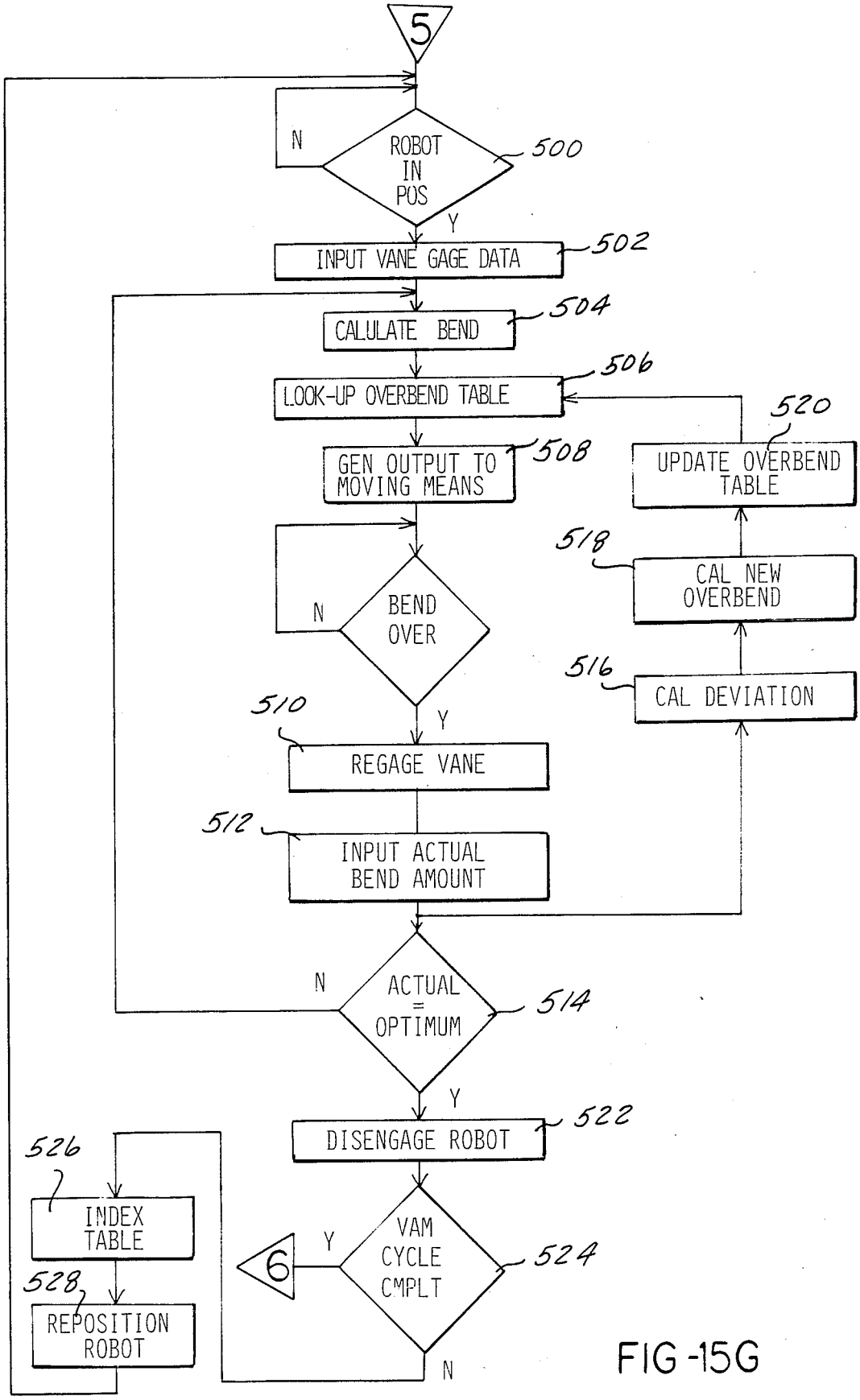

Referring now to FIGS. 15E and 15F, there is illustrated a flow diagram of the vane adjustment routine of the control program.

After step 426 in FIG. 15D, when an adjustment to a particular vane is required for optimum flow, the control program generates prompt commands which result in the operator loading the part in the vane adjustment machine and entering the part bar code number in steps 420 and 422, respectively, as shown in FIG. 15E. The control program then determines if the part number is a master number in step 424, and, if it is, displays a message "PART IS A MASTER, LOAD A NEW PART" in step 446. If the part is not a master part, the control program determines if the part is to be reworked. If the part is not to be reworked, but is to be adjusted, the control program determines the proper tooling to be used in step 450 and the operator enters the proper tooling number in step 452. The control program then checks that the tooling is correct is step 454 by comparing the tooling number in step 452 with the tooling code as input to the computer 18 via a connector associated with each tool which inputs a control signal indicative of the tooling number.

If the tool number and the entered tool number are not correct, the control program generates a message in step 456 indicating an error requiring either an abort or a retry. The operator may then enter an abort in step 458 or a retry in step 460 as shown in FIG. 15E.

If the tool numbers match, the control program determines if the part and fixture are oriented correctly and clamped in step 462. If not, an error message is displayed in step 464. When the part and fixture are correctly oriented and clamped, the control program generates an "INITIATE ROBOT PROGRAM" prompt 466 directing the operator to take action in step 468 to initiate the robot program. The control program displays a "ROBOT PROGRAM IN PROCESS" message during operation of the robot. Next, the control program generates a display prompting "PRESS 'D' FOR VANE DATA DISPLAY" in step 472. If the operator desires a display of the vane data, he presses key "D" on the keyboard 22 in step 474, thereby displaying the vane data in step 476 as it is generated on each vane.

The control program checks in steps 478 and 480 if the vane adjustment machine (VAM) cycle is complete, and if so, date and time marks the data and stores it in the memory in the computer 18 in step 482.

The operator has various options available at the completion of the vane adjustment machine cycle and the control program generates a prompt display in step 484 prompting the operator to press "F1" to generate a statistical report or "F2" for no report. Depending upon which keys, "F1" or "F2", is pressed, either no report or a statistical report is displayed and printed as shown in the sequence steps in FIG. 15F. At the completion of the printing of the report, or in the event that no report is required, the control program completes its sequence cycle by generating a display in step 486 indicating "VAM CYCLE COMPLETE—RE-FLOW TEST" indicating that a particular VAM operation has been completed and that it is now necessary to re-flow test the part by returning to the sequence steps shown in FIGS. 15C and 15D.

In obtaining an optimum airflow through a turbine, each vane must have an optimum position or orientation. Such position varies for each turbine configuration. As described above, activation of the robot program causes the robot to move into position to detect the actual position of the vane and its deviation from the optimum position. The memory in computer 18 contains stored values corresponding to the amount of bending distance required for each vane to move it to the optimum position. Thus, if the robot senses that a particular vane is 0.0040 inches up from the optimum position, a command will be generated to the pusher and to bend a particular vane a predetermined amount. However, due to springback of the vane after bending, it is necessary to overbend the vane a predetermined amount so that the springback results in an optimum position of the vane after springback. Thus, to obtain a bend of 0.0040 inches, it may be necessary to initially bend the vane 0.0080 inches, thereby allowing springback to the desired 0.0040 inch position.

The computer utilizes a self-teaching routine by recording all bending information relating to as how much bend is required, how much overbend was generated and how much bend was actually obtained after springback. This information is recorded for each vane and the results interpolated or averaged so as to obtain the amount of bend necessary to achieve optimum vane position with springback on the first try. Thus, the control system, in effect, self-teaches itself that for a particular vane, for example, if a 0.0040 inches of bend is required, that it must impart a bend of 0.0096 to the vane to generate the desired amount of bend after springback. This information may be displayed as described above, as well as stored in memory for statistical report purposes or part history records.

The computer 18 is operably coupled to the robot 10 and the indexing table 12 of the vane adjustment machine 14 for transmitting input and output signals therebetween. Upon initiating the robot program in step 468, an output signal from the robot 10 is received by the computer 18 in step 500, FIG. 15G, indicating that the robot arm is in position. The robot also outputs vane gage data which is input to the computer 18 in step 502. The gage data is utilized by the computer 18 to calculate the amount of bend of the vane in step 504. This data is utilized with an overbend look-up table stored in memory in step 506 to generate an output value indicating the amount of bend to be imparted to the vane, taking into account the springback characteristics of the vane. The overbend table originally has values stored in it for known springback characteristics and is updated through a self-teaching routine as described hereafter.

The central processing unit of the computer 18 generates an output to the moving means of the vane adjustment machine in step 508 corresponding to the amount of bend required. The computer 18 checks to determine if the bend operation has been completed, and, when completed, activates the robot to regage the vane in step 510. The computer 18 then receives the actual amount of bend of the vane in step 512. This is compared with the optimum bend required in step 514. If the actual amount of bend does not equal the optimum amount of bend, the control program calculates a new bend distance in step 504 and repeats the intervening sequence steps until the actual amount of bend in the vane equals the optimum amount of bend required for the optimum amount of airflow through the turbine.

Upon each regaging of a vane, a control program calculates in step 516 the deviation between the actual amount of bend imparted to the vane and the amount of overbend. The control program then calculates a new overbend value taking into account the springback characteristics as shown in step 518 by interpolating the difference between successive actual bend measurements and generated overbend calculations and updates the overbend look-up table in step 520. This reduces the amount of successive bending operations required to bring a vane to the optimum position via the self-teaching routine as the control program gradually "learns" the required amount of overbend necessary to move the vane to the optimum position.

When the actual amount of bend in the vane equals the optimum amount of bend, the control program generates output signals to the robot disengaging the robot from the particular vane as shown in step 522. The control program checks to determine if the vane adjustment machine (VAM) cycle has been completed in step 524 and, if so, transfers control to the reflow program sequence shown in FIGS. 15D and 15E.

If the VAM cycle is not complete, that is, not all of the vanes have been gaged for actual bending position compared to the optimum position, the control program generates output signals causing the index table 12 to index to the next vane as shown in step 526 and activates the robot to reposition the robot in step 528 for the next vane gaging operation. The control program then sequences through the steps shown in FIG. 15G for each successive vane on the turbine until all of the vanes have been checked and/or adjusted if necessary.

Having disclosed certain preferred embodiments of the invention for purposes of explanation, further modifications or variations thereof, after study of this specification, will or may occur or become apparent to persons skilled in the art to which the invention pertains. Reference should be made to the appended claims in determining the scope of the invention.

The invention claimed is:

1. An apparatus for adjusting fluid flow through a turbine nozzle having rotor vanes, said apparatus comprising:

air flow testing means for determining an air flow value through said turbine nozzle;

a central processing unit in communication with the air flow testing means and having memory means for storing air flow test values and a stored control program;

a bending tool responsive to the central processing unit, said bending tool having an interchangeable subassembly with opposing vane-engaging surface means for shaping and bending a rotor vane based on the air flow test values;

rotor arm means responsive to the central processing unit for moving the bending tool along a predetermined path into and out of proximity with the rotor vane, such that a rotor vane is disposed between the opposing vane-engaging surface means when the bending tool is in proximity with the rotor vane; and rotatable work surface means in communication with the central processing unit and responsive to the control program for supporting and rotating the turbine nozzle such that successive rotor vanes move to a bending station location on the predetermined path of the bending tool.

2. The apparatus of claim 1 further comprising:

a frame connectable to a robotic arm for three dimensional movement;

a floating head attached to the frame with a plurality of spring biased ball and socket joints urging the floating head toward a neutral position, while allowing movement of the floating head relative to a rotor vane for squared alignment of the floating head with respect to the rotor vane;

an elongated movable member having a threaded portion at one end and a vane-engaging surface at another end, the movable member passing through the floating head and the frame for movement along an axis to clamp the rotor vane between the floating head and the vane-engaging surface; and means mateable with the threaded portion of the movable member, for moving the movable member along the axis.

3. The apparatus of claim 2 further comprising:

means, responsive to engagement of the vane-engaging surface with the rotor vane, for sensing the actual position of the rotor vane;

means for comparing the actual position of the rotor vane to an optimum position of the rotor vane; and means for calculating a bending force to be applied to the rotor vane to bend the rotor vane from the actual position to the optimum position.

4. The apparatus of claim 3 further comprising:

means, engageable with the rotor vane, for initializing a first rotor vane at a bending station location.

5. The apparatus of claim 1, wherein the bending tool further comprises:

a frame connectable to the robot arm means;

a floating head supported by the frame;

means for pivoting the floating head relative to the frame allowing alignment of the floating head square with respect to the rotor vane;

means for biasing the floating head toward a neutral position, while allowing movement of the floating head through the pivoting means;

said opposing vane-engaging surface means including a first vane-engaging surface formed on said floating head and a movable member supported by said floating head having a second vane-engaging surface opposing said first surface and movable with respect to said first surface; and means, supported by the floating head and engageable with the movable member, for moving the movable member in response to the control program.

6. The apparatus of claim 5, wherein the moving means comprises:

said movable member having a threaded portion;

threaded means engageable with the threaded portion of the movable member for moving the movable member linearly along a fixed path relative to the floating head;

anti-rotation means slidably engaging the movable member for securing the movable member against rotational movement, while allowing linear movement of the movable member along said fixed path;

gear means for rotating the threaded means about an axis; and motor means for driving the gear means in response to said central processing unit.

7. The apparatus of claim 1, wherein said interchangeable sub-assembly means further comprises:

identification means for signalling to the central processing unit an identification code identifying the vane-engaging surface means connected to the floating head.

8. The apparatus of claim 1 wherein said opposing vane-engaging surface means comprises:

said first vane-engaging surface having a generally concave surface; and said second vane-engaging surface having a generally convex surface for increasing fluid flow through said turbine nozzle by engaging successive vanes on said turbine nozzle between said first and second vane-engaging surfaces.

9. The apparatus of claim 1, wherein said opposing vane-engaging surface means comprises:

said first vane-engaging surface having a generally convex surface; and said second vane-engaging surface having a generally concave surface for reducing fluid flow through said turbine nozzle by engaging successive vanes on said turbine nozzle between said first and second vane-engaging surfaces.

10. A method for testing and adjusting fluid flow through a turbine nozzle having rotor vanes, said method comprising the steps of:

air flow testing the turbine nozzle to determine an air flow value through the turbine nozzle;

communicating the air flow value to a central processing unit having memory means for storing air flow test values and a stored control program for directing movement of a robot arm and a bending tool;

mounting the turbine nozzle on a rotatable work surface;

attaching a sub-assembly to the bending tool having vane-engaging surfaces for bending and shaping the rotor vane;

bending and shaping the rotor vane with the bending tool controlled by the central processing unit, wherein the central processing unit controls the bending and shaping operation based on the air flow test values for the turbine nozzle; and rotating a rotatable work surface supporting the turbine nozzle such that another rotor vane moves to a bending station location on a predetermined path of the bending tool.

11. The method of claim 10 further comprising the steps of:

(a) initializing a first rotor vane to an inspecting and bending station location;

(b) inserting the bending tool into proximity with the vane, such that the tool is disposed above the vane with a movable member disposed below the vane for movement toward the vane;

(c) moving the movable member toward the vane;

(d) sensing an actual position of the vane when the movable member touches the vane;

(e) comparing the actual position of the vane to an optimum position for the vane;

(f) calculating a bending force required to bend the vane from the actual position to the optimum position;

(g) applying the calculated bending force to the vane to bend the vane;

(h) releasing the bending force, allowing the vane to spring back; and (i) removing the tool from proximity with the vane.

12. The method of claim 11 further comprising the steps of:

(a) moving the movable member toward the vane after releasing the bending force;

(b) sensing a bent position of the vane when the movable member touches the vane;

(c) comparing the bent position of the vane to the optimum position;

(d) calculating a bending force required to bend the vane from the bent position to the optimum position;

(e) applying the bending force calculated to the vane;

(f) releasing the bending force allowing the vane to spring back; and repairing steps a through f as required until the bent position of the vane reaches the optimum position for the vane.

13. The method of claim 12 further comprising the steps of:

repeating steps b through i for each successive vane on the turbine nozzle until all vanes of the turbine nozzle have been bent to the optimum position.

14. The method of claim 10 further comprising the steps of:

sensing the actual position of the vane;

comparing the actual position with a predetermined position of the vane for optimum air flow through the turbine nozzle;

determining the difference between the actual position and the predetermined position on the vane;

if the difference is not within a predetermined range with respect to the predetermined position, calculating a number with respect to the difference between the actual and predetermined positions of the vane to compensate for springback of the vane after bending of the vane; and bending the vane an amount equal to the calculated number.

15. The method of claim 14 further including the steps of:

re-sensing the actual position of the vane after the first bending;

determining a second difference between the re-sensed actual position of the vane and the predetermined position of the vane for optimum air flow through the turbine nozzle;

if the re-sensed actual position is not within a predetermined range with respect to the predetermined position, calculating a second number with respect to the difference between the re-sensed actual position and the predetermined position of the vane to compensate for springback of the vane after bending;

re-bending the vane an amount equal to the second number; and repeating the above steps as required until the actual position of the vane reaches the predetermined position.

16. The method of claim 10 further comprising the steps of:

sensing the actual position of a vane on the turbine nozzle;

comparing the actual position with a predetermined position on the vane corresponding to optimum air flow through the turbine nozzle;

if the actual position is not within a predetermined range with respect to the predetermined position of the vane calculating a first number with respect to the difference between the actual position and the predetermined position to compensate to springback of the vane after bending;

bending the vane an amount equal to the first number;

re-sensing a second actual position of the vane;

determining a second difference between the second actual position and the predetermined position;

if the second actual position is not within a predetermined range with respect to the predetermined position, recalculating a second number with respect to the difference between the re-sensed second actual position and the predetermined position of the vane to compensate for springback of the vane after bending;

re-bending the vane an amount equal to the second number;

re-sensing a third actual position of the vane after re-bending; and calculating a bending value which is a combination of the first and second differences, the first and second calculated numbers and the sensed third actual position with respect to the predetermined position to substantially equalize the bending amount required to move a vane from the first actual sensed position of the vane to the predetermined position of the vane in a single bending operation.

17. The method of claim 10 further comprising the steps of:

comparing the actual air flow value of air through the turbine nozzle with a predetermined acceptable value;

determining the difference between the actual air flow value and the predetermined acceptable value;

if acceptable, approving the turbine nozzle for use;

if not acceptable:

(a) mounting the non-acceptable turbine nozzle on a work surface;

(b) sensing the actual position of a first vane on the turbine nozzle;

(c) comparing the actual position of the first vane with a predetermined position of the vane for optimum air flow through the turbine nozzle;

(d) determining a first difference between the actual sense position of the first vane and the predetermined position of the first vane;

(e) if the actual first position is not within a predetermined range with respect to the predetermined position of the vane, calculating a number with respect to the differences between the actual position and the predetermined position of the vane to compensate for springback of the vane after bending;

(f) bending the vane an amount equal to the calculated number;

(g) advancing the turbine nozzle to the next vane;

(h) repeating steps b through g for each successive vane until all of the vanes on the turbine nozzle have been checked;

(i) reflow testing the turbine nozzle to determine the air flow through the turbine nozzle;

(j) comparing the retest results with a predetermined acceptable air flow value; and (k) determining if the turbine nozzle is acceptable or not acceptable.

18. The method of claim 17 further comprising after step f, the following steps:

(l) re-sensing the actual position of the first vane;

(m) re-comparing the re-sensed actual position of the first vane with the predetermined position of the vane for optimum air flow through the rotor;

(n) determining the second difference between the re-sensed actual position of the first vane and the predetermined position of the vane;

(o) if the second difference is not within a predetermind range with respect to the predetermined position of the vane, calculating a second number with respect to the difference to compensate for springback of the vane after bending;

(p) re-bending the first vane an amount equal to the calculated second number;

(q) re-sensing the actual position of the vanes; and (r) repeating sub-steps l through q until the actual position of the vane equals the predetermined position of the vane.

19. An apparatus for adjusting fluid flow through a turbine nozzle having rotor vanes comprising:

air flow testing means for determining an air flow value through said turbine nozzle;

a central processing unit having memory means for storing air flow test values and a stored control program;

rotatable work surface means responsive to the control program for supporting and rotating a turbine nozzle, such that successive rotor vanes move to a bending station location in response to signals from the control program;

means for initializing a first rotor vane to the bending station location;

means for clamping the turbine nozzle to the rotatable work surface means;

robot arm means responsive to the control program for moving along a predetermined path into and out of proximity with the rotor vane at the bending station location; and a bending tool responsive to the control program for shaping and bending a rotor vane based on the air flow test values of the turbine nozzle, said bending tool having a frame connected to the robot arm means, a floating head supported by the frame, means for pivoting the floating head relative to the frame allowing alignment of the floating head square with respect to the rotor vane, means for biasing the floating head toward a neutral position while allowing movement of the floating head through the pivoting means, an anvil connected to the floating head and having a first vane-engaging surface, a movable member supported by the floating head for linear movement along a fixed path relative to the floating head, said movable member having a second vane engaging surface opposing said first vane-engaging surface and a threaded portion, threaded means engageable with the threaded portion of the movable member for moving the movable member linearly along said fixed path, anti-rotation means slidably engaging the movable member for securing the movable member against rotational movement while allowing linear movement along said fixed path, gear means for rotating the threaded means about an axis, motor means for driving the gear means in response to the control program and means responsive to engagement with the rotor vane for sensing an actual position of the rotor vane, wherein the robot arm means moves the bending tool into and out of proximity with the rotor vane in response to the control program and the bending tool shapes and bends the rotor vane based on the air flow test values in response to the control program by engaging the rotor vane between the first and second vane-engaging surfaces.

* * * * *